United States Patent [19]

Koboshi et al.

[11] Patent Number: 4,518,680

[45] Date of Patent: May 21, 1985

[54] BLEACH-FIXING SOLUTION AND PROCESSING OF LIGHT-SENSITIVE COLOR PHOTOGRAPHIC MATERIAL BY USE THEREOF

[75] Inventors: Shigeharu Koboshi; Masao Ishikawa; Kazuhiro Kobayashi; Toshihiko Kimura; Moeko Higuchi, all of Hino, Japan

[73] Assignee: Konishiroku Photo Industry Co., Ltd., Tokyo, Japan

[21] Appl. No.: 578,551

[22] Filed: Feb. 9, 1984

[30] Foreign Application Priority Data

Feb. 17, 1983 [JP] Japan ..... 58-23766
Feb. 18, 1983 [JP] Japan ..... 58-24863

[51] Int. Cl.[3] ..... G03C 7/00; G03C 5/38; G03C 7/34

[52] U.S. Cl. ..... 430/393; 430/460; 430/384; 430/385; 430/552; 430/553

[58] Field of Search ..... 430/393, 460, 461, 418, 430/384, 430, 552, 385, 553

[56] References Cited

U.S. PATENT DOCUMENTS

| | | | |
|---|---|---|---|
| 3,293,036 | 12/1966 | Meckl et al. | 430/393 |
| 3,615,508 | 10/1971 | Stephen et al. | 430/393 |
| 4,304,844 | 12/1981 | Fujimatsu et al. | 430/552 |
| 4,451,559 | 5/1984 | Sato et al. | 430/553 |

*Primary Examiner*—Mary F. Downey
*Attorney, Agent, or Firm*—Frishauf, Holtz, Goodman & Woodward

[57] ABSTRACT

Disclosed is a bleach-fixing solution for light-sensitive silver halide color photographic material, comprising a diethylenetriamine pentaacetic acid iron (III) complex salt and having a pH value of 4.0 or higher. Also disclosed is a method for processing a light-sensitive silver halide color photographic material, which comprises processing a light-sensitive silver halide color photographic material containing a cyan coupler by the use of the above bleach-fixing solution.

12 Claims, No Drawings

BLEACH-FIXING SOLUTION AND PROCESSING OF LIGHT-SENSITIVE COLOR PHOTOGRAPHIC MATERIAL BY USE THEREOF

BACKGROUND OF THE INVENTION

This invention relates to a bleach-fixing solution and a method for processing a light-sensitive silver halide color photographic material by using the same. More particularly, this invention pertains to a method for processing of a light-sensitive silver halide color photographic material which has been dramatically improved in storage stability of a bleach-fixing solution employed and also improved in bleaching speed.

In the prior art, as the so called bleaching agent for removing the image silver in a light-sensitive silver halide photographic material, oxidizing agents such as red prussiate, dichromate, persulfate, iron chloride, etc. have been employed, but they involved problems in toxicity or corrosion of the members in processing machines and are not sufficiently satisfactory in practical application.

In recent years, in view of absence of problems with respect to toxicity, methods have been practiced, in which an aminopolycarboxylic acid metal complex is utilized as the oxidizing agent in a bleaching solution or a bleach-fixing solution.

However, an aminocarboxylilc acid metal complex has a weak oxidizing power and therefore has the drawback of slow bleaching speed, which brings about the drawback that no one-bath bleach-fixing processing, particularly required for rapid processing of a high sensitivity light-sensitive silver halide color photographic material, is possible. Practically, ethylenediaminetetraacetic acid iron (III) complex salt, which is considered to have a potent bleaching power among the aminopolycarboxylic acid metal complexes, is utilized also as the bleach-fixing solution in some applications. However, it is deficient in bleaching action in high sensitivity light-sensitive silver halide color photographic materials composed primarily of silver bromide or silver iodobromide emulsions, particularly color paper for photographing, color negative film for photographic and color reversal film containing silver iodide, whereby traces of image silver will remain even after prolonged processing to give poor silver elimination characteristic. Further, as the increase of silver salt or iodine ion concentration dissolved and accumulated in the processing solution, bleaching power will be markedly lowered. Particularly, at a pH 4 or higher, this will appear markedly with a dissolved accumulation of 5 g of silver ions per liter. On the other hand, at a pH value less than 4, silver ion accumulation has only very small effect on the bleaching power. Moreover, in a bleach-fixing solution in which an oxidizing agent together with a thiosulfate and a sulfite are co-present, due to lowering in redox potential, poor silver elimination tendency will markedly be exhibited.

In the prior art, for overcoming these problems, a bleaching promotor is added to a bleach-fixing solution using primarily ethylenediaminetetraacetic acid iron (III) complex salt as the oxidizing agent, as disclosed in Japanese Patent Publication Nos. 8506/1970, 556/1981 and Japanese Unexamined Patent Publications Nos. 280/1971 and 5630/1974. However, no satisfactory bleaching promoting effect can be necessarily obtained or there is involved the problem such that the silver accumulated by dissolution will form a slightly soluble precipitate. Thus, none of these solutions of the prior art proved to be acceptable as the practical bleach-fixing solution for high sensitivity silver halide color photographic materials.

As an alternative method, it has also been practiced to perform processing, when employing an ethylenediaminetetraacetic acid iron (III) complex salt at a low pH region so that its bleaching power may strongly be exhibited. This method, however, is well known to have serious problems such that the co-existing thiosulfate or sulfite is readily decomposable to give low stability of the solution, and also that the chromogenic dye, particularly a cyan dye is liable to be converted to leuco form, thereby to give no sufficient sensible image.

If processing is conducted at a higher pH side for solving this problem, while the leuco dye may be decreased, silver elimination characteristic will be lowered as the increase of pH, simultaneously with disadvantageous formation of dye staining through coupling between the oxidized product and the residual coupler (hereinafter called as stain), whereby no satisfactory bleach-fixing processing performance could be obtained.

As another method for solving the problems, one may easily think of a method in which a coupler which may hardly form a leuco dye, particularly a cyan coupler of the phenol type having 2,5-diacylamino group, is employed and processing is performed with a bleach-fixing solution using a low pH ethylenediaminetetraacetic acid iron (III) complex salt as the oxidizing agent or a bleach-fixing solution using a glycoletherdiaminetetraacetic acid iron (III) complex salt as the oxidizing agent. However, even if leuco formation of cyan dye or bleaching speed may be attained as expected, decomposition of co-existing sulfite or thiosulfate will occur noticeably in a low pH bleach-fixing solution. Therefore, such a method can hardly be practically applicable with respect to stability of the processing solution.

Thus, in the case when a high sensitive light-sensitive color photographic material for photographing is processed with the use of a bleach-fixing solution containing an ethylenediaminetetraacetic acid iron (III) complex salt of the prior art, there can be seen no sufficiently satisfactory approach, in which the four problems of rapid silver bleaching power, leuco formation of cyan dye, prevention of generation of stain and further storage stability of bleach-fixing solution (particularly sulfide formation from thiosulfate) are simultaneously solved. Accordingly, appearance of a bleach-fixing processing system for a high sensitivity light-sensitive color photographic material, which can solve these four problems at the same time as required for bleach-fixing solution, has been earnestly sought after.

SUMMARY OF THE INVENTION

An object of this invention is to provide a bleach-fixing liquid for light-sensitive silver halide color photographic material which is endowed with rapid silver bleaching power and improved in all of leuco formation of a cyan dye and prevention of generation of stain, further storage stability of the bleach-fixing solution.

Another object of this invention is to provide a method for processing a light-sensitive silver halide color photographic material, which is endowed with rapid silver bleaching power and improved in all of leuco formation of a cyan dye and prevention of generation of stain, further storage stability of the bleach-fixing solution.

Still another object of this invention is to provide a rapid processing method for a high sensitivity light-sensitive color photographic material for photographing containing a specific cyan coupler.

In one aspect of this invention, there is provided a bleach-fixing solution for light-sensitive silver halide color photographic material, comprising a diethylenetriamine pentaacetic acid iron (III) complex salt and having a pH value of 4 or higher.

In another aspect of this invention, there is also provided a method for processing a light-sensitive silver halide color photographic material, which comprises processing a light-sensitive silver halide color photographic material containing a cyan coupler with a bleach-fixing solution containing diethylenetriamine pentaacetic acid iron (III) complex salt and having a pH value of 4 or higher.

In a preferred embodiment of the above method, there is provided a method for processing a light-sensitive silver halide color photographic material, which comprises processing a light-sensitive silver halide color photographic material containing at least one kind of cyan couplers represented by the formula [I] or the formula [II] shown below with a bleach-fixing solution containing a diethylenetriamine pentaacetic acid iron (III) complex salt and having a pH value of 4 or higher.

Formula [I]

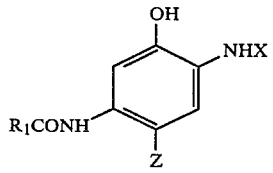

Formula [II]

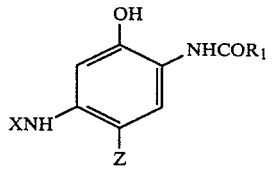

[wherein X is $-COR_2$, $-CON\begin{matrix}R_2\\R_3\end{matrix}$, $-SO_2R_2$, $-\underset{\underset{S}{\|}}{C}-N\begin{matrix}R_2\\R_3\end{matrix}$, $-SO_2N\begin{matrix}R_2\\R_3\end{matrix}$, $-SO_2NHCON\begin{matrix}R_2\\R_3\end{matrix}$, $-CONHCOR_2$ or $-CONHSO_2R_2$ ($R_2$ represents an alkyl group, an alkenyl group, a cycloalkyl group, an aryl group or a heterocyclic ring; $R_3$ represents a hydrogen atom, an alkyl group, an alkenyl group, a cycloalkyl group, an aryl ring or a heterocyclic group; or $R_2$ and $R_3$ may be bonded to each other to form a 5- to 6-membered ring), $R_1$ is a ballast group, Z is a hydrogen atom or an eliminable group through coupling with the oxidized product of an aromatic primary amine color developing agent.

DESCRIPTION OF PREFERRED EMBODIMENTS

Generally speaking, the specific features of the bleach-fixing solution using an aminopolycarboxylic acid iron (III) complex salt at an elevated pH of the processing solution may be summarized as follows:

(1) Redox potential becomes lower (or base) and silver bleaching force is lowered.

(2) When bleaching processing is applied directly from color development, stain is particularly increased and stopping charateristic is lowered.

(3) Leuco formation of a cyan dye through proton addition will difficultly occur.

(4) Decomposition of a thiosulfate or a sulfite is retarded, whereby stability of the processing solution is enhanced.

On the other hand, lowering of pH is known to result in reversing the above specific features, namely:

(1) Oxidative power is increased (or noble in redox potential) and silver bleaching power is improved.

(2) Stain through oxidative coupling will be difficultly formed.

(3) Leuco formation of a cyan dye through proton addition becomes liable to occur.

(4) Decomposition of a thiosulfate or a sulfite is accelerated, whereby stability of the processing solution is lowered.

Whereas, the present inventors have found that the specific features formerly known for aminopolycaroxylic acids are not exhibited in the case of a diethylenetriamine pentaacetic acid iron (III) complex salt.

More specifically, in a bleach-fixing solution using an ordinary aminopolycarboxylic acid iron (III) complex salt, the redox potential becomes base as the increase of pH. That is to say, for example, with an increase from pH 4 to pH 8, lowering by about −140 mv (vs SCE) can be seen. However, to be surprising enough, in the case of a diethylenetriamine pentaacetic acid iron (III) complex salt, only a difference by about −8 mv was found to exist from pH 4 to pH 9.

On the other hand, when the bleaching speed of the image silver was measured, the results were found to coincide substantially with those of redox potential. Thus, it has also been found that the silver elimination speed is not lowered at all in a bleach-fixing solution comprising a diethylenetriamine pentaacetic acid iron (III) complex salt even by increase of pH, as contrasted to the bleach-fixing solution comprising an aminopolycarboxylic acid iron (III) complex salt in general which will be lowered in silver bleaching power abruptly at pH 6.8 or higher, particularly pH 7.5 or higher, to make silver elilmination impossible, and also that said diethlenetriamine pentaacetic acid iron (III) complex salt can maintin higher bleaching power than an ethylenediaminetetraacetic acid iron (III) complex salt. However, it was also found that at a low pH, particularly lower than pH 4, an ethylenediaminetetraacetic acid iron (III) complex salt was found to be higher in redox potential as well as in silver bleaching power.

Also, when the silver ion concentration accumulated by dissolution according to processing in a bleach-fixing solution is preferably 5 to 50 g/liter when calculated in terms of metallic silver, silver bleaching power will abruptly be lowered in a bleach-fixing solution comprising an ethylenediaminetetraacetic acid iron (III) complex salt, and its bleaching power is markedly lowered at a pH exceeding 4. In contrast, in the case of a diethylenetriamine pentaacetic acid iron (III) complex salt, it has been found that lowering in silver bleaching power is small at a pH value of 4 or higher even when silver ion may be accumulated by dissolution at high concentration. In particular, at a pH 5 or higher, the silver bleaching power is not affected at all, even if the pH may be increased higher.

Further, in a bleach-fixing solution comprising a diethylenetriamine pentaacetic acid iron (III) complex salt, the result of little generation of stain was obtained even at any high pH and under the condition where a color developer is sufficiently mixed into the bleach-fixing solution (in the prior art bleach-fixing solution, stain was found to be increased as pH becomes higher).

Further, with respect to decomposition of a thiosulfate, namely sulfide formation from hypo, a surprising fact has also been found that it will difficultly occur abruptly at a pH of 4 or higher until no sulfide formation occurs at pH 5 or higher even when a sulfite which is the preservative may be substantially zero.

However, in the case when the pH of the bleach-fixing solution is higher, in the region where a sulfite is near zero, generation of stain through cyan fogging was found to occur in processing of a light-sensitive material employing a cyan coupler known in the art. The present inventors have made extensive studies on this point and consequent newly found that no stain through cyan fogging occurs at all even in the case of processing with the bleach-fixing solution of this invention after color development by use of a coupler of the formula [I] or [II].

The foregoing various advantages can be accomplished for the first time by a bleach-fixing solution employing a diethylenetriamine pentaacetic acid iron (III) complex salt as the oxidizing agent, and no difference in cyan fogging was recognized in a bleach-fixing solution of the prior art employing an ethylenediaminetetraacetic acid iron (III) complex salt.

The aforesaid characteristics obtained by processing of a light-sensitive silver halide high sensitivity color photographic material containing the cyan coupler of the formula [I] or [II] by using the bleach-fixing solution comprising a diethylenetriamine pentaacetic acid iron (III) complex salt according to this invention are epoch-making in that ultra-high speed processing of a light-sensitive high sensitivity color photographic material is rendered possible without any problem and stably, because leuco formation and stain of a cyan dye are difficultly generated, and the processing solution can be stored very stably and has a high bleaching performance.

The matters as described above have been clarified for the first time by the present inventors and they are entirely unexpected from the knowledge commonly accepted in the art.

The cyan couplers represented by the formula [I] and the formula [II] to be used in the preferred embodiment of the present invention are now explained. In the above formulae [I] and [II], X is a group represented by $-COR_2$,

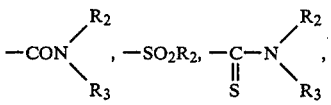

-continued

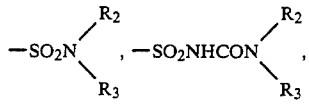

$-CONHCOR_2$ or $-CONHSO_2R_2$. Here, $R_2$ represents an alkyl group (preferably an alkyl group having 1 to 20 carbon atoms such as methyl, ethyl, t-butyl, dodecyl and the like), an alkenyl group (preferably an alkenyl group having 2 to 20 carbon atoms such as allyl, heptadecenyl and the like), a cycloalkyl group (preferably a 5- to 7-membered ring such as cyclohexyl), an aryl group (phenyl group, tolyl group, naphthyl group and the like), a heterocyclic group (preferably a 5- to 6-membered ring containing 1 to 4 nitrogen atom, oxygen atom or sulfur atom, such as furyl group, thienyl group, benzothiazolyl group and others). $R_3$ represents a hydrogen atom or a group represented by $R_2$. $R_2$ and $R_3$ may be bonded to each other to form a 5- to 6-membered heterocyclic ring. $R_2$ and $R_3$ can also have any desired substituent introduced therein, which may be selected from, for example, alkyl groups having 1 to 10 carbon atoms (e.g. ethyl, i-propyl, i-butyl, t-butyl, t-octyl and the like), aryl groups (e.g. phenyl, naphthyl), halogen atoms (fluorine, chlorine, bromine, etc.), cyano, nitro, sulfonamide groups (e.g. methanesulfonamide, butanesulfonamide, p-toluensulfonamide and the like), sulfamoyl groups (e.g. methylsulfamoyl, phenylsulfamoyl, etc.), sulfonyl groups (e.g. methanesulfonyl, p-toluenesulfonyl and the like), fluorosulfonyl, carbamoyl groups (e.g. dimethylcarbamoyl, phenylcarbamoyl and the like), oxycarbonyl groups (e.g. ethoxycarbonyl, phenoxycarbonyl and the like), acyl groups (e.g. acetyl, benzoyl and the like), heterocyclic groups (e.g. pyridyl group, pyrazolyl group and others), alkoxy groups, aryloxy groups and acyloxy groups.

In the formulae [I] and [II], $R_1$ represents a ballast group necessary for imparting diffusion resistance to the cyan coupler represented by the formulae [I] and [II] and the cyan dye formed from said cyan coupler. Preferable groups are alkyl groups having 4 to 30 carbon groups, aryl groups, heterocyclic groups, alkenyl groups, or cycloalkyl groups. For example, there may be included straight or branched alkyl groups (e.g. t-butyl, n-octyl, t-octyl, n-dodecyl and the lkie), and 5- to 6-membered heterocyclic groups.

In the formulae [I] and [II], Z represents a hydrogen atom or an eliminable group during the coupling reaction with the oxidized product of a color developing agent. For example, there may be employed a halogen atom (chlorine, bromine or fluorine), an aryloxy group, a carbamoyloxy group, a carbamoylmethoxy group, an acyloxy group, a sulfonamide group or a succinimide group, of which oxygen atom or nitrogen atom is bonded directly to the coupling position. Further, specific examples may include those as disclosed in U.S. Pat. No. 3,741,563, Japanese Unexamined Patent Publication No. 37425/1972, Japanese Patent Publication No. 36894/1973, Japanese Unexamined Patent Publication Nos. 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981 and 27147/1981.

In this invention, the cyan couplers represented by the formula [III], the formula [IV] or the formula [V] shown below are further preferable.

Formula [III]

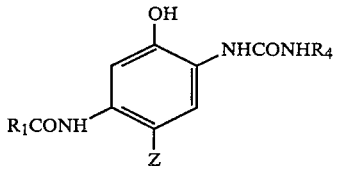

Formula [IV]

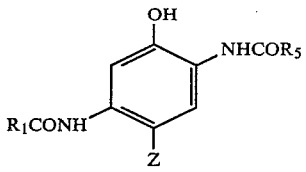

Formula [V]

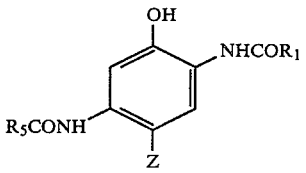

In the formula [III], $R_4$ is a substituted or unsubstituted aryl group (particularly preferably a phenyl group). When the aryl group has a substituent, preferable substituents may include at least one selected from $-SO_2R_2$, halogen atoms (e.g. fluorine, bromine or chlorine), $-CF_3$, $-NO_2$, $-CN$, $-COR_6$, $-COOR_6$, $-SO_2OR_6$,

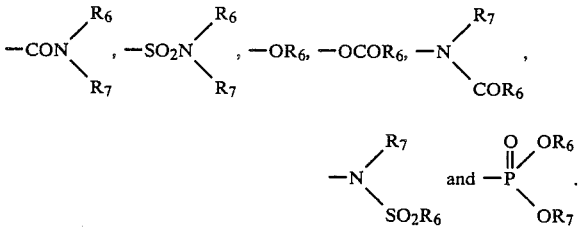

Here, $R_6$ represents an alkyl group (preferably an alkyl group having 1 to 20 carbon atoms, such as methyl, ethyl, tert-butyl, dodecyl and the like), an alkenyl group (preferably an alkenyl group having 2 to 20 carbon atoms, such as an allyl group, a heptadecenyl group), a cycloalkyl group (preferably a 5- to 7-membered ring, such as cyclohexyl group) or an aryl group (phenyl group, tolyl group, naphthyl group), and $R_7$ represents a hydrogen atom or a group represented by the above $R_6$.

Preferable compounds of the phenol type cyan coupler represented by the formula [III] are those wherein $R_4$ is a substituted or unsubstituted phenyl group, including substituents on the phenyl group such as cyano, nitro, $-SO_2R_6$ ($R_6$ is an alkyl group), a halogen atom and trifluoromethyl.

In the formulae [IV] and [V], $R_5$ is an alkyl group (preferably an alkyl group having 1 to 20 carbon atoms, such as methyl, ethyl, tert-butyl, dodecyl and the like), an alkenyl group (preferably an alkenyl group having 2 to 20 carbon atoms, such as an allyl group, a heptadecenyl group), a cycloalkyl group (preferably a 5- to 7-membered ring, such as cyclohexyl group) or an aryl group (phenyl group, tolyl group, naphthyl group), or a heterocyclic group (preferably a 5- to 6-membered heterocyclic ring containing 1 to 4 nitrogen atom, oxygen atom or sulfur atom, such as furyl group, thienyl group, benzothiazolyl group and others).

The groups $R_6$ and $R_7$ in the formula [III] and the group $R_5$ in the formula [V] may also have any desired substituents introduced therein. Specific examples may include the substituents which can be introduced into $R_2$ *and* $R_3$ in the formulae [I] and [II]. And, as the substituent, halogen atoms (chlorine atom, fluorine atom, and others) are particularly preferred.

In the formulae [III], [IV] and [V], each of Z and $R_1$ have the same meaning as in the formulae [I] and [II]. Preferable ballast groups represented by $R_1$ are those represented by the formula [VI] shown below:

Formula [VI]

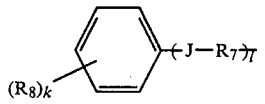

In the above formula, J represents an oxygen atom or a sulfur atom or a sulfonyl group; k is an integer of 0 to 4; l is 0 or 1; when k is 2 or more, $R_8$ exsiting in number of two or more may be either the same or different; $R_7$ is an alkylene group having 1 to 20 carbon atoms which may be straight, branched or substituted with aryl or other groups; $R_8$ represents a monovalent group, including hydrogen atom, halogen atoms (preferably chlorine, bromine), alkyl groups {preferably straight or branched alkyl groups having 1 to 20 carbon atoms (e.g. methyl, t-butyl, t-pentyl, t-octyl, dodecyl, pentadecyl, benzyl, phenetyl)}, aryl groups (e.g. phenyl), heterocyclic groups (preferably nitrogen containing heterocyclic groups), alkoxy groups (preferably straight or branched alkoxy groups having 1 to 20 carbon atoms such as methoxy, ethoxy, t-butyloxy, octyloxy, decyloxy, dodecyloxy), aryloxy groups (e.g. phenoxy), hydroxy, acyloxy groups {preferably alkylcarbonyloxy groups, arylcarbonyloxy groups (e.g. acetoxy, benzoyloxy)}, carboxy, alkyloxycarbonyl groups (preferably straight or branched alkyloxycarbonyl groups having 1 to 20 carbon atoms), aryloxycarbonyl groups (preferably phenoxycarbonyl), alkylthio groups (preferably having 1 to 20 carbon atoms), acyl groups (preferably straight or branched alkylcarbonyl groups having 1 to 20 carbon atoms), acylamino groups (preferably straight or branched alkylcarboamide having 1 to 20 carbon atoms, benzenecarboamide), sulfonamide groups (preferably straight or branched alkylsulfonamide groups having 1 to 20 carbon atoms, benzenesulfonamide group), carbamoyl groups (preferably straight or branched alkylaminocarbonyl groups having 1 to 20 carbon atoms, phenylaminocarbonyl group) and sulfamoyl groups (preferably straight or branched alkylaminosulfonyl groups having 1 to 20 carbon atoms, phenylaminosulfonyl group).

Specific exemplary compounds of the cyan couplers of the formula [I] or [II] to be used in a preferred embodiment of this invention are set forth below.

[Exemplary compounds]
(1)
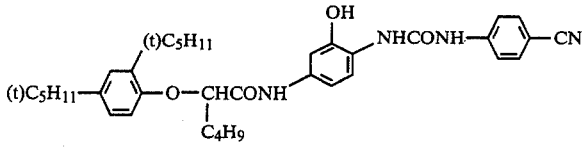
(2)
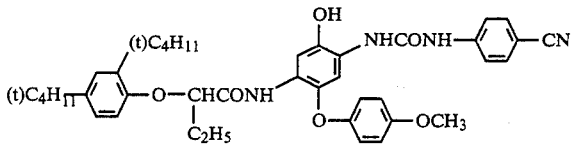
(3)
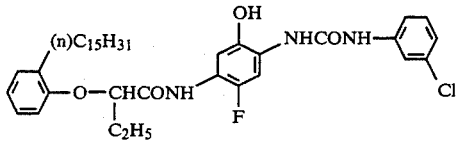
(4)
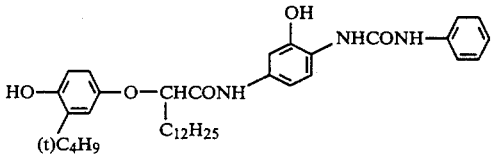
(5)
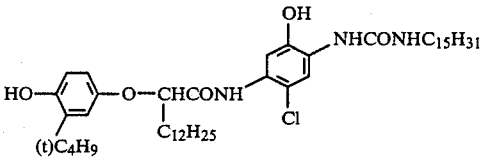
(6)
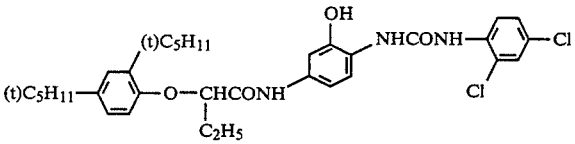
(7)
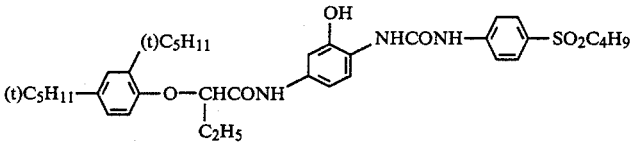
(8)
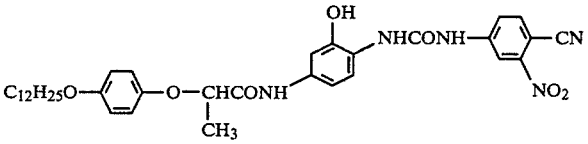
(9)
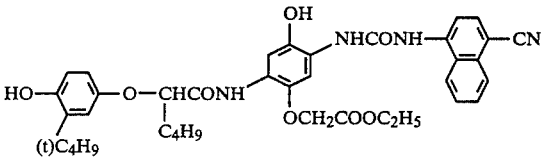
(10)
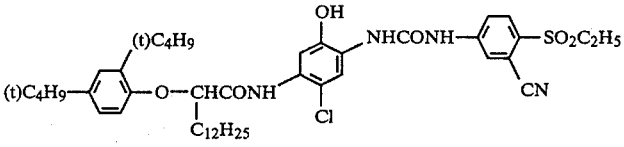
(11)
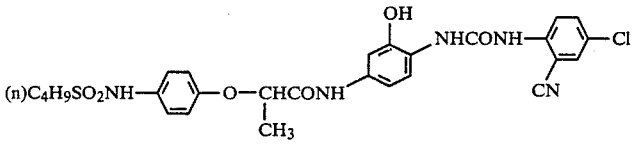
(12)
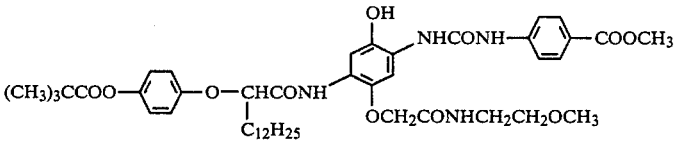

-continued
[Exemplary compounds]
(13)
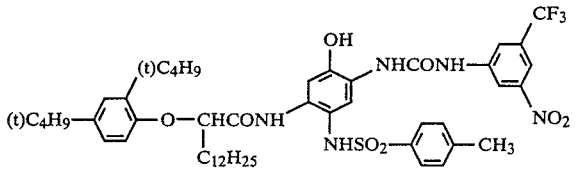
(14)
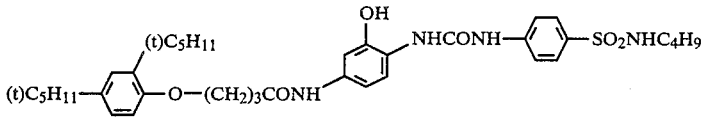
(15)
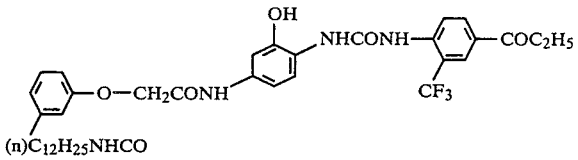
(16)
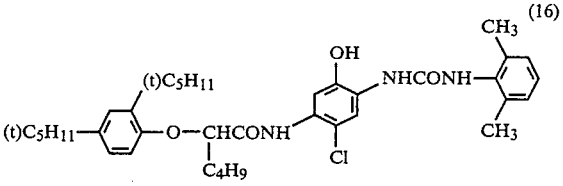
(17)
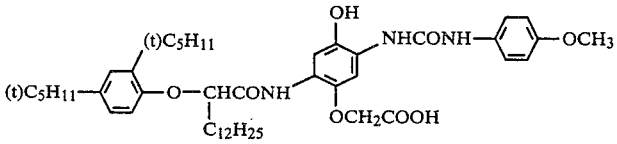
(18)
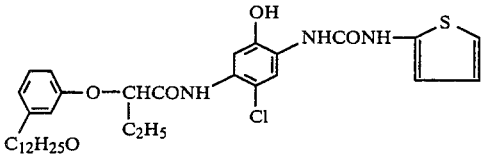
(19)
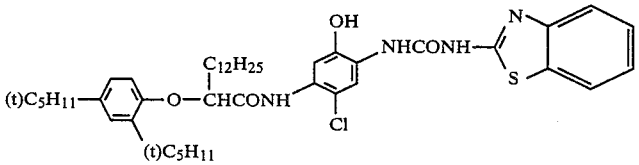
(20)
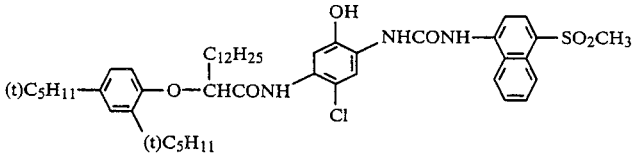
(21)
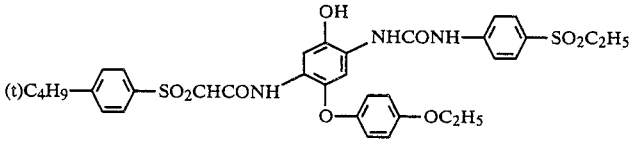

-continued
[Exemplary compounds]
(22)
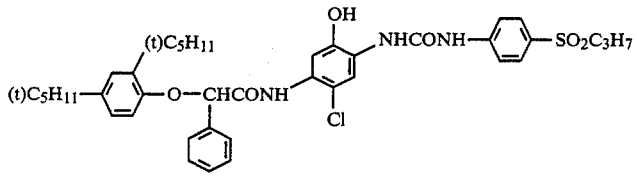
(23)
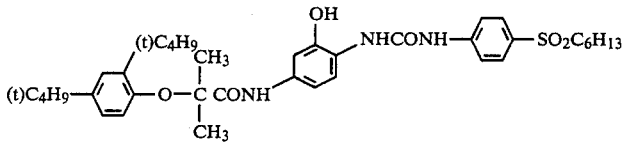
(24)
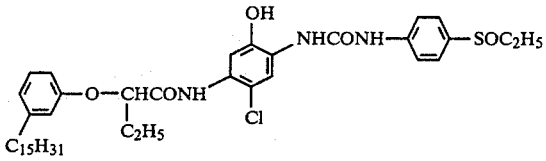
(25)
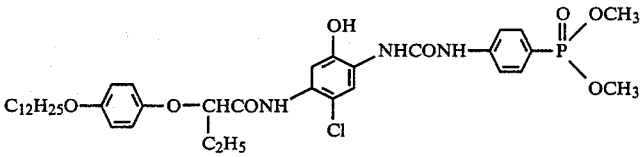
(26)
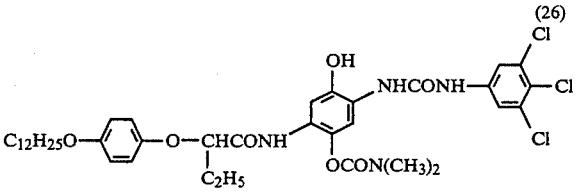
(27)
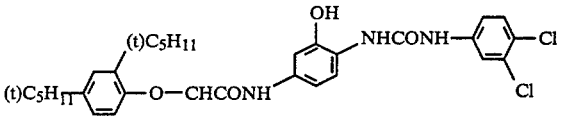
(28)
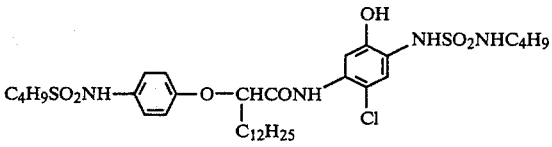
(29)
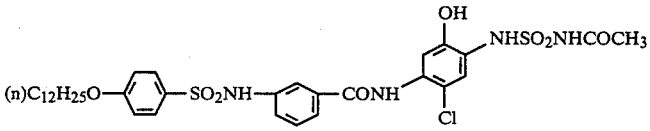
(30)
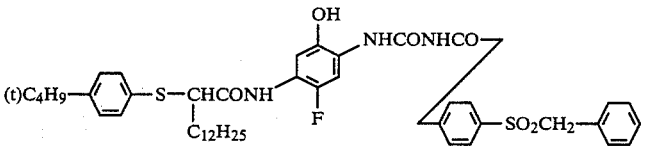

-continued
[Exemplary compounds]
(31)
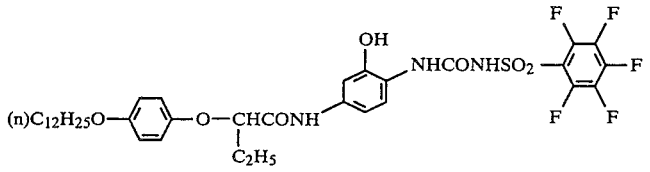
(32)
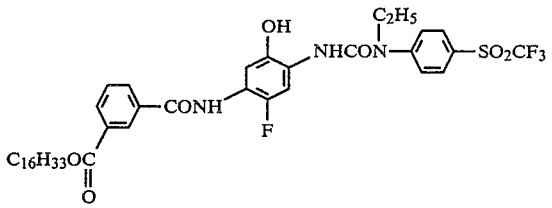
(33)
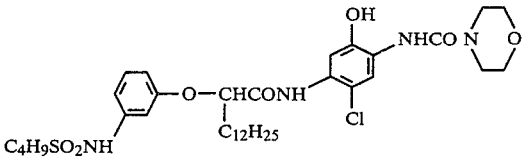
(34)
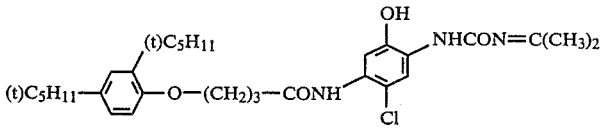
(35)
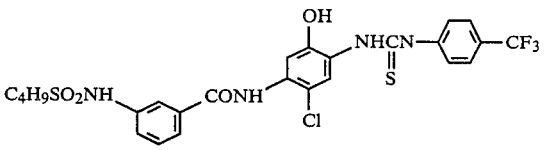
(36)
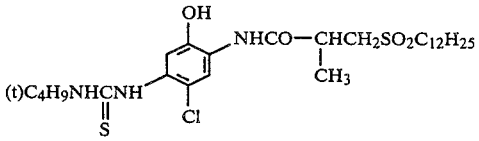
(37)
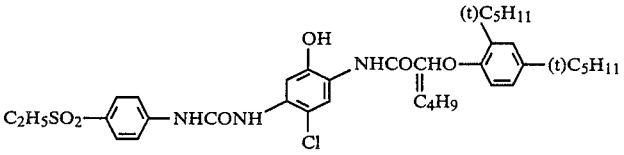
(38)
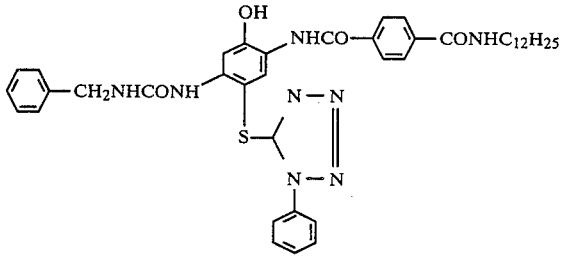
(39)
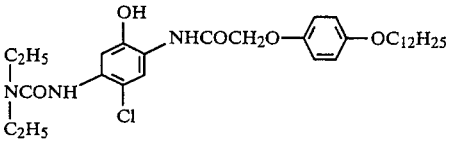
(40)
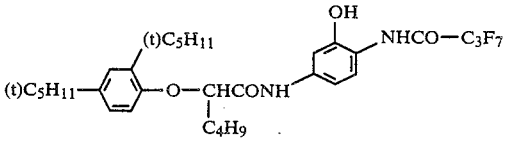
(41)
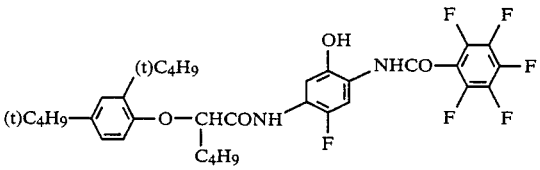

-continued
[Exemplary compounds]
(42)
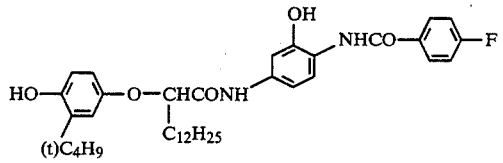
(43)
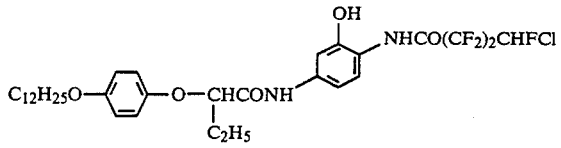
(44)
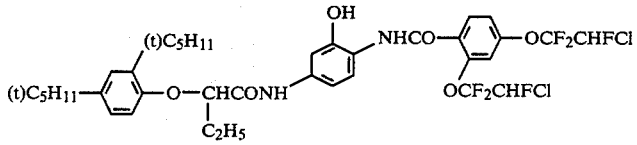
(45)
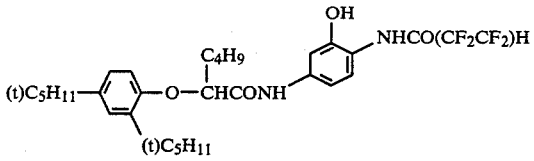
(46)
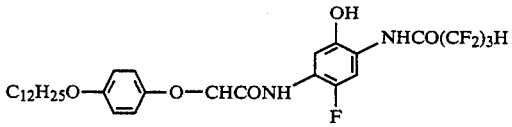
(47)
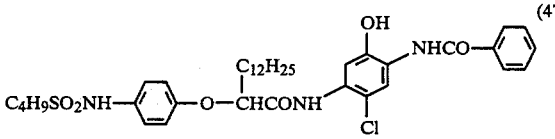
(48)
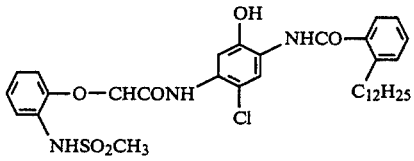
(49)
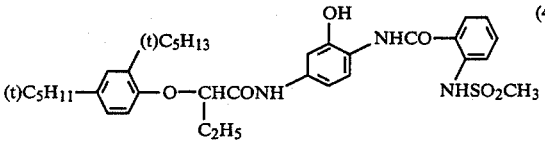
(50)
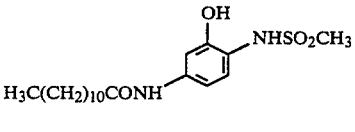
(51)
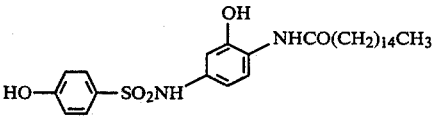
(52)
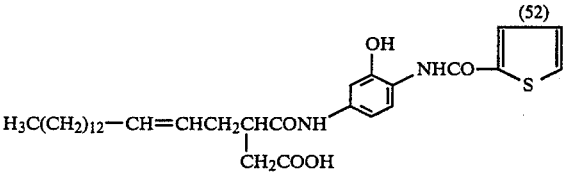
(53)
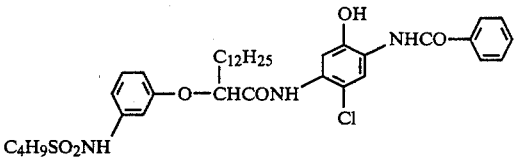
(54)
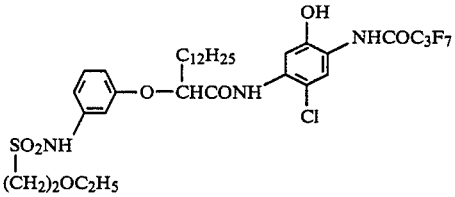

-continued
[Exemplary compounds]
(55)
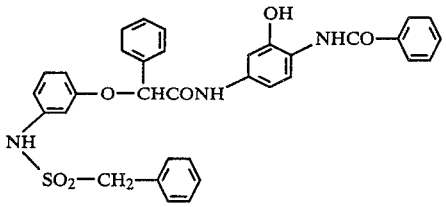
(56)
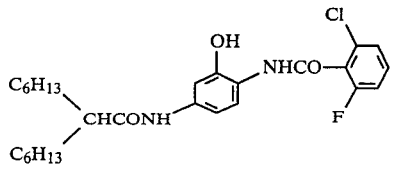
(57)
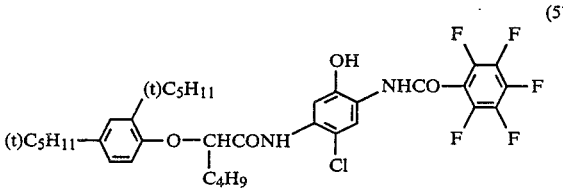
(58)
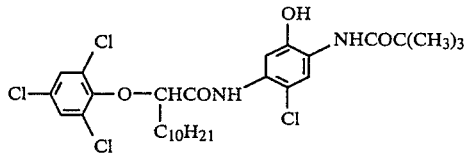
(59)
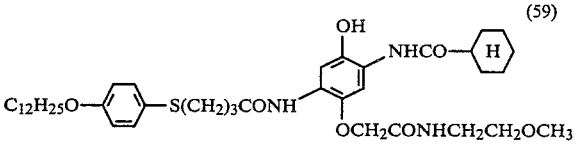
(60)
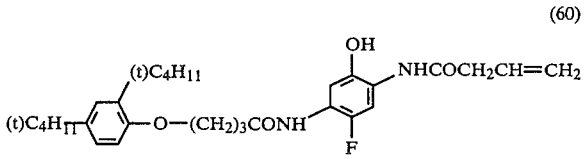
(61)
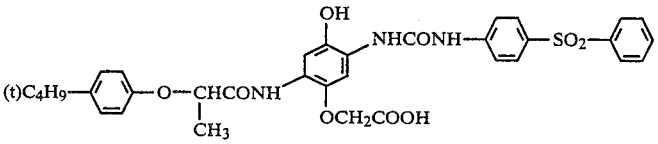
(62)
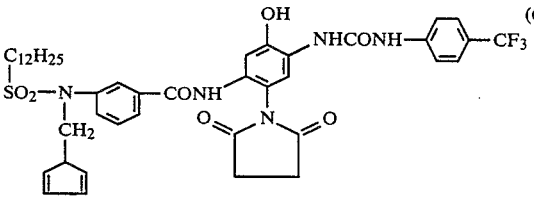
(63)
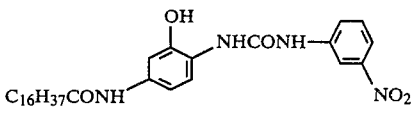
(64)
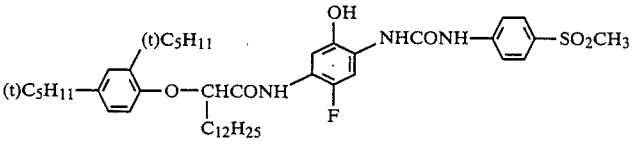
(65)
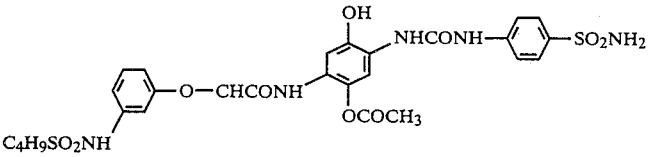

-continued

[Exemplary compounds]

(66)

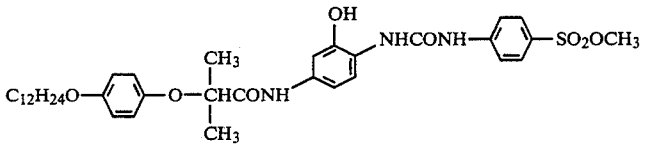

(67)

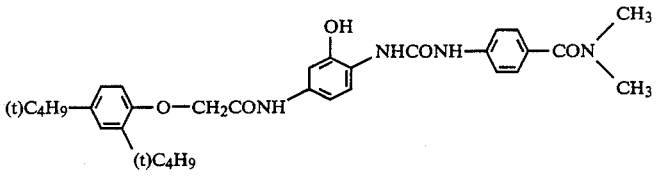

(68)

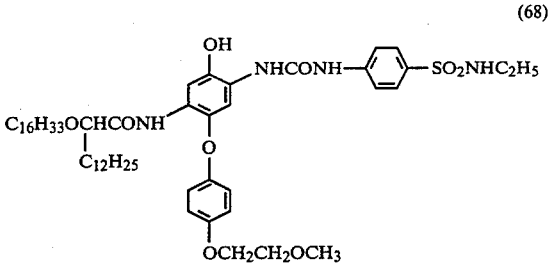

(69)

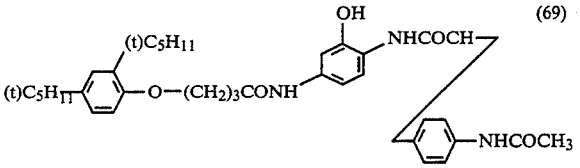

These cyan couplers can be synthesized according to the methods known in the art, including those disclosed in U.S. Pat. Nos. 2,772,162; 3,758,308; 3,880,661; 4,124,396; 3,222,176; U.K. Pat. Nos. 975,773; 8.011,693; 8,011,694; Japanese Unexamined Patent Publications Nos. 21139/1972, 112038/1975, 163537/19880, 29235/1981, 99341/1980, 116030/1981, 69329/1977, 55945/1981, 80045/1981, 134644/1975; and also U.K. Pat. No. 1,011,940; U.S. Pat. Nos. 3,446,622; 3,996,253; Japanese Unexamined Patent Publications Nos. 65134/1981, 204543/1982, 204544/1982, 204545/1982; Japanese Unexamined Patent Publications Nos. 33249/1983, 33251/1983, 33252/1983, 33250/1983, 33248/1983 and 31334/1983.

The diethylenetriamine pentaacetic acid iron (III) complex salt according to this invention may be used as an alkali metal salt such as sodium salt, potassium salt or lithium salt, or an ammonium salt or an aqueous amine salt such as triethanolamine salt. These iron (III) complex salts may be used either alone or as a combination of two or more species. The amount to be used may be chosen as desired, depending on the silver quantity in the light-sensitive material and the composition of the silver halide. Since the complex salt is generally higher in oxidative power, it can be used at a lower concentration than other aminopolycarboxylilc acid salts. For example, it can be used at 0.01 mole or more per one liter of the solution used, preferably 0.05 to 1 mole. In this connection, in a supplementing solution, for the purpose of supplementing at a low level with conc. solution, it is desirable to make its concentration up to saturation of the solubility.

The bleach-fixing solution of this invention may be used at a pH of 4 or higher, generally in the range of from pH 5 to pH 9, preferably from pH 6 to pH 8.5, most preferably from pH 6.5 to pH 8.5. The processing temperature employed may be 80° C. or lower, preferably 55° C. or lower, while suppressing evaporation.

As the bleach-fixing solution to be used in this invention, there may be applied a solution having a composition, containing as the bleaching agent a diethylenetriamine pentaacetic acid iron (III) complex salt and also containing a silver halide fixing agent such as thiosulfate, thiocyanate, thiourea or thioether and a sulfite as the preservative. It is also possible to use a bleach-fixing solution having a composition, comprising a small amount of a halide such as potassium bromide added to a diethylenetriamine pentaacetic acid iron (III) complex salt bleaching agent and the aforesaid silver halide fixing agent, or a bleach-fixing solution with a composition, comprising contrariwise a large amount of a halide such as potassium bromide added, or further a special bleach-fixing solution with a composition, comprising a combination of diethylenetriamine pentaacetic acid iron (III) complex salt bleaching agent and a large amount of a halide such as potassium bromide. As the above mentioned halide, in addition to potassium bromide, there may also be employed hydrochloric acid, hydrobromic acid, lithium bromide, sodium bromide, ammonium bromide, sodium iodide, potassium iodide, ammonium iodide and the like.

The silver halide fixing agent to be incorporated in the bleach-fixing solution may include compounds which can react with a silver halide conventionally used for fixing processing in general to form a water-soluble complex salt, typically thiosulfates such as potassium thiosulfate, sodium thiosulfate, ammonium thiosulfate; thiocyanates such as potassium thiocyanate, sodium thiocyanate, ammonium thiocyanate; or thiourea, thioether, etc. These fixing agents may be used in amounts of from 5 g/liter up to soluble amounts.

It is also possible to incorporate in the bleach-fixing solution a pH buffering agent comprising various acids, bases or salts such as of boric acid, borax, sodium hydroxide, potassium hydroxide, sodium carbonate, potassium carbonate, sodium bicarbonate, potassium bicarbonate, acetic acid, sodium acetate, ammonium hydroxide, etc. either singly or as a combination of two or more species. Further, various fluorescent whiteners, defoaming agents or surfactants may also be incorporated. Moreover, it is also possible to incorporate suitably preservatives such as bisulfite adducts of hydroxylamine, hydrazine, aldehyde compounds; organic chelating agent such as aminopolycarboxylic acids; stabilizers such as nitroalcohol nitrate; organic solvents such as methanol, dimethylsulfamide, dimethyl sulfoxide, etc.

The black-and-white developer to be used for processing of this invention may be the developer called as black-and-white first developer generally used for light-sensitive color photographic material known in the art or the developer used for processing of light-sensitive black-and-white photographic materials, and various additives generally added to a black-and-white developer may be incorporated therein.

Typical additives may include developing agents such as 1-phenyl-3-pyrazolidone, Metol and hydroquinone; preservatives such as sulfites; accelerators comprising an alkali such as sodium hydroxide, sodium carbonate, potassium carbonate and the like; inorganic or organic inhibitors such as potassium bromide, 2-methylbenzimidazole, methylbenzthiazole and others; hard water softeners such as polyphosphoric acid salts; and surface excessive development preventives comprising minute amount of an iodide or a mercapto compound.

The aromatic primary amine color developing agent to be used in the color developer to be used in this invention may include those known in the art which have widely been used in various color photographic processes. These developers include aminophenol type and p-phenylenediamine type derivatives. These compounds are generally used in salt forms such as hydrochlorides or sulfates, which are more stable than free states. These compounds may be used generally at a concentration of about 0.1 g to about 30 g per one liter of a color forming developer, more preferably about 1 g to about 15 g per one liter of a color developer.

Aminophenol type developers may include, for example, o-aminophenol, p-aminophenol, 5-amino-2-oxytoluene, 2-amino-3-oxy-toluene, 2-oxy-3-amino-1,4-dimethylbenzene and the like.

Particularly useful primary aromatic aminotype color developers are N,N-dialkyl-p-phenylenediamine type compounds, of which alkyl group and phenyl group may be either substituted or unsubstituted. Among them, examples of particularly useful compounds may include N-diethyl-p-phenylenediamine hydrochloride, N-N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, 4-amino-N-(2-methoxyethyl)-N-ethyl-3-methylaniline-p-toluenesulfonate and the like.

The alkaline color developer to be used in the processing of this invention may also contain, in addition to the aforesaid primary aromatic amine type color developer, various components conventionally added to a color developer, such as alkali agents (e.g. sodium hydroxide, sodium carbonate, potassium carbonate), water softeners and thickeners (e.g. alkali metal sulfites, alkali metal bisulfites, alkali metal thiocyanates, alkali halides, benzyl alcohol, diethylenetriamine pentaacetate, 1-hydroxy-ethylidene-1,1-diphosphonic acid), if desired. This color developer may have a pH value, which is usually 7 or higher, most generally about 10 to about 13.

In the processing method of this invention, the most preferable processing system is to perform bleach-fixing processing immediately after developing. Alternatively, bleach-fixing processing may be also conducted after such processings as washing, or rinse and stopping. Also, a pre-bath containing a bleach-promoter may also be used as the processing solution prior to bleach-fixing. After bleach-fixing, stabilizing processing may be performed either without washing with water or after washing with water.

The light-sensitive silver halide color photographic material applicable for this invention may be the internal type development system containing cyan couplers of the formula [I] or [II] or other chromogenic agents in the light-sensitive material (see U.S. Pat. Nos. 2,376,679 and 2,801,171) or otherwise the external type development system wherein a chromogenic agent is contained in the developer (see U.S. Pat. Nos. 2,252,718, 2,592,243, and 2,590,970). The chromogenic agent may be, in addition to the cyan coupler of the formula [I] or [II], any desired coupler known in the art, which may also be used in combination with the cyan coupler of this invention. As known couplers, there may be included cyan chromogenic agents having a basic structure of naphthol or phenol and capable of an indoaniline dye through coupling; magenta chromogenic agents having a skeltal structure of 5-pyrazolone ring having an active methylene group; yellow chromogenic agents having a structure of benzoylacetanilide, pivalylacetanilide or acylacetanilide having an active methylene chain, either having or not having a substituent at the coupling position. As such chromogenic agents, either the so called divalent type coupler or tetravalent type coupler may be applicable. Also, polymeric couplers or latex couplers may also be available. A silver halide emulsion avilable may be one employing any of silver halides such as silver chloride, silver bromide, silver iodide, silver chlorobromide, silver chloroiodide, silver iodobromide, silver chloroiodobromide and the like. As the protective colloid for these silver halides, various colloids may be available, including natural products such as gelatin as well as synthetic ones. The silver halide emulsion may also include conventional additives for photography such as stabilizers, sensitizers, film hardeners, sensitizing dyes, surfactants, etc.

This invention is described in detail below by referring to Examples, by which, however, this invention is not limited.

EXAMPLE 1

| | |
|---|---|
| [Bleach-fixing solution (1)] | |
| Ethylenediaminetetraacetic acid iron (III) ammonium salt | 70 g |
| Ethylenediamine tetraacetic acid | 20 g |
| Ammonium sulfite (50% solution) | 5 ml |
| Ammonium thiosulfate (70% solution) | 140 ml |
| Ammonia water (28% solution) | 30 ml |
| Water added to make up | 1000 ml |
| [Bleach-fixing solution (2)] | |
| Diethylenetriamine pentaacetic acid iron (III) ammonium salt salt | 85 g |

-continued

| | |
|---|---|
| Diethylenetriamine pentaacetic acid | 25 g |
| Ammonium sulfite (50% solution) | 5 ml |
| Ammonium thiosulfate (70% solution) | 140 ml |
| Ammonia water (28% solution) | 30 ml |
| Water added to make up | 1000 ml |

The above bleach-fixing solutions were varied in pH values as indicated in Table 1 below with the use of ammonia water or acetic acid, and each solution was left to stand in a glass beaker at 38° C. and the days until formation of a sulfide were observed.

TABLE 1

| | pH: | | | | | | |
|---|---|---|---|---|---|---|---|
| | 3.0 | 4.0 | 5.0 | 6.0 | 7.0 | 8.0 | 9.0 |
| Bleach-fixing solution (1): | (a) | (b) | (c) | (d) | (e) | (f) | (g) |
| | 3 days | 4 days | 6 days | 12 days | 16 days | 24 days | 35 days |
| Bleach-fixing solution (2): | (h) | (i) | (j) | (k) | (l) | (m) | (n) |
| | 18 days | 46 days | no generation for 50 days or longer | the same as the left | the same as the left | the same as the left | the same as the left |

From the results in Table 1, it can be seen that the bleach-fixing solutions of the invention, (j) to (n), are stable over very long time at a pH of 4.0 or higher, particularly 5.0 or higher, without formation of sulfide. In contrast, in Control bleach-fixing solutions (1), (a) to (g) and the bleach-fixing solutions (2), (h) and (i), large amounts of sulfides were observed to have been formed at low pH regions, and also a slight generation was observed even at pH 8.0 in Control solutions (1).

From the above results, it can be understood that in the bleach-fixing solution (2) of this invention within the pH value of this invention, no formation of sulfide is seen even in the presence of a very low level of a sulfite of 3 g/liter or less, thus indicating very high storage stability of the bleach-fixing solution of this invention, as compared with Control.

EXAMPLE 2

After Sakura Color II (a high sensitivity color negative film, produced by Konishiroku Photo Industry, Co., Ltd.) was subjected to exposure in a conventional manner and then the following processings were applied:

| Processing step | Processing temperature | Processing time |
|---|---|---|
| 1. Color developing | 37.8° C. | 3 min. 15 sec. |
| 2. Bleach-fixing | 37.8° C. | 1 min.-30 min. |
| 3. Water washing | 30-34° C. | 2 min. |
| 4. Stabilizing | 30-34° C. | 1 min. |
| 5. Drying | | |

The following color developer and stabilizer were employed.

| | |
|---|---|
| [Color developer] | |
| Potassium carbonate | 30 g |
| Sodium sulfite | 2.0 g |
| Hydroxylamine sulfate | 2.0 g |
| Potassium bromide | 1.2 g |
| Sodium hydroxide | 3.4 g |
| N—ethyl-N—β-hydroxyethyl-3-methyl-4-aminoalinine hydrochloride | 4.6 g |

-continued

| | |
|---|---|
| (made up to 1000 ml with addition of water, and adjusted to pH 10.1 with sodium hydroxide) | |
| [Stabilizer] | |
| Formalin (35% aqueous solution) | 7.0 ml |
| 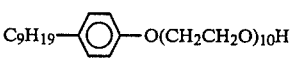 | 1.0 g |
| Water | added to make up 1000 ml |

The bleach-fixing solutions of Example 1, (a)-(n), were stored for 10 days, adjusted to pH values as indicated in Table 2 and provided for processings. The silver elimination completion time, namely clearing time, was measured, and the maximum red density (cyan dye density) and the minimum green density (magenta stain) of the film obtained after further bleach-fixing processing for 30 minutes. The results are shown in Table 2.

As a Control, a sample processed by the standard processing of Sakura nega color process CNK-4 was also measured in the same manner, except that for the silver elimination processing, bleaching processing was conducted for 6 minutes and 30 seconds and the fixing processing for 6 minutes and 30 seconds.

TABLE 2

| | pH | Clearing time | Maximum red density | Minimum green density |
|---|---|---|---|---|
| | | Bleach-fixing solution (1): | | |
| (a) | (3.0) | 6 min. 30 sec. | 2.08 | 0.58 |
| (b) | (4.0) | 9 min. 30 sec. | 2.09 | 0.58 |
| (c) | (5.0) | 18 min. | 2.16 | 0.68 |
| (d) | (6.0) | 23 min. | 3.02 | 0.74 |
| (e) | (7.0) | >30 min. | 3.41 | 0.79 |
| (f) | (8.0) | >30 min. | 3.43 | 0.79 |
| (g) | (9.0) | >30 min. | 3.43 | 0.80 |
| | | Bleach-fixing solution (2): | | |
| (h) | (3.0) | 7 min. 30 sec. | 1.98 | 0.57 |
| (i) | (4.0) | 7 min. 30 sec. | 2.48 | 0.57 |
| (j) | (5.0) | 8 min. | 2.61 | 0.57 |
| (k) | (6.0) | 8 min. | 2.62 | 0.59 |
| (l) | (7.0) | 8 min. | 2.62 | 0.59 |
| (m) | (8.0) | 8 min. | 2.62 | 0.62 |
| (n) | (9.0) | 8 min. 30 sec. | 2.62 | 0.63 |
| | Standard processing | | 2.62 | 0.58 |

As can be seen from the results in Table 2, in processings using the bleach-fixing solutions according to the invention (i) to (n) were employed, clearing time was short and the maximum red density coincides substantially with 2.62 of the standard processing, and the minimum green density was approximate to 0.58 of the standard processing. Thus, there is substantially no problem.

On the other hand, in the processings (a) to (i) outside the scope of the invention, at least one of clearing time, the maximum red density and the minimum green density is inferior, thus failing to satisfy all of the items as different from this invention.

EXAMPLE 3

To each one liter of the bleach-fixing solutions (a)–(n) used in Example 2 were added 7 g of silver chloride and 2 g of potassium iodide, and processings were performed with the use of the same sample films as in Example 2. The bleach-fixing processing was conducted for 1 to 30 minutes and clearing time was measured. The maximum red density of the sample subjected to further processing for 30 minutes was measured. These results are shown in Table 3.

TABLE 3

| | Bleach-fixing solution (1) | | | | | | | Bleach-fixing solution (2) | | | | | | |
|---|---|---|---|---|---|---|---|---|---|---|---|---|---|---|
| | a | b | c | d | e | f | g | h | i | j | k | l | m | n |
| pH: | 3 | 4 | 5 | 6 | 7 | 8 | 9 | 3 | 4 | 5 | 6 | 7 | 8 | 9 |
| Clearing time (min.): | 8 | >18 | >30 | >30 | >30 | >30 | >30 | 8 | 8 | 9 | 9 | 9 | 9 | 9 |
| Maximum red density | 2.18 | 1.91 | 2.22 | 3.46 | 3.48 | 3.47 | 3.46 | 2.02 | 2.48 | 2.54 | 2.51 | 2.56 | 2.54 | 2.54 |

As can be seen also from the results in Table 3, in bleach-fixing solutions (a) to (g), bleaching speed is markedly lowered by addition of silver ions and iodine ions, and the maximum red density is markedly lower than the standard value of 2.62 in (a) to (c) of pH 5.0 or lower, in spite of the fact that silver elimination has already been completed even when carried out for 30 minutes. Also, in (d) to (g), since silver elimination is not yet completed, the maximum red density becomes very high. On the other hand, even in a bleach-fixing solution comprising diethylenetriamine pentaacetic acid, (h) of a very low pH, the result is not satisfactory with low maximum red density, although silver elimination has been completed. However, in the bleach-fixing solutions (i) to (n) according to this invention, even when pH may be elevated, it has no substantial effect on the clearing time, and the maximum red density is approximate to 2.62, the value in the case of the standard processing. Thus, processing is workable without any problem.

EXAMPLE 4

Bleach-fixing solutions comprising recipes as shown below were prepared, in which each 0.25 mol/liter of nitrilotriacetic acid iron (III) complex salt, ethylenediaminetetraacetic acid iron (III) complex salt, diethylenetriaminepentaacetic acid iron (III) complex salt and cyclohexanediaminetetraacetic acid iron (III) complex salt was employed as the aminopolycarboxylic acid iron (III) complex salt, and the pH of each bleach-fixing solution was varied as 3.0, 4.5, 6.0, 7.5 and 9.0.

On the other hand, on a transparent cellulose triacetate film support, a dispersion of colloidal silver in gelatin was applied to a silver quantity coated of 50 mg/100 $cm^2$ to obtain a sample. By using this sample, bleaching speed was measured with the use of the bleach-fixing solutions (a) to (t) to determine the bleaching speed constants. These results are shown in Table 4.

| [Bleach-fixing solution] | |
|---|---|
| Aminopolycarboxylic acid iron (III) complex salt (as shown in Table 4) | 0.25 mole |
| Ammonium sulfite | 10 g |
| Ammonium thiosulfate | 120 g |
| (made up to 1000 ml with water, and pH adjusted with ammonium hydroxide and glacial acetic acid) | |

TABLE 4

| | Kind of aminocarboxylic acid iron (III) complex | pH | Bleaching speed constant [K]× $10^3$ |
|---|---|---|---|
| a: | Nitrilotriacetic acid iron (III) ammonium salt | 3.0 | 8.6 |
| b: | Nitrilotriacetic acid iron (III) ammonium salt | 4.5 | 6.8 |
| c: | Nitrilotriacetic acid iron (III) ammonium salt | 6.0 | 4.2 |
| d: | Nitrilotriacetic acid iron (III) ammonium salt | 7.5 | 3.3 |
| e: | Nitrilotriacetic acid iron (III) ammonium salt | 9.0 | 2.1 |
| f: | Ethylenediaminetetra-acetic acid iron (III) ammonium salt | 3.0 | 12.1 |
| g: | Ethylenediaminetera-acetic acid iron (III) ammonium salt | 4.5 | 8.2 |
| h: | Ethylenediaminetera-acetic acid iron (III) ammonium salt | 6.0 | 6.6 |
| i: | Ethylenediaminetera-acetic acid iron (III) ammonium salt | 7.5 | 4.5 |
| j: | Ethylenediaminetera-acetic acid iron (III) ammonium salt | 9.0 | 3.9 |
| k: | Cyclohexanediamine tetraacetic acid iron (III) ammonium salt | 3.0 | 13.8 |
| l: | Cyclohexanediamine tetraacetic acid iron (III) ammonium salt | 4.5 | 8.6 |
| m: | Cyclohexanediamine tetraacetic acid iron (III) ammonium salt | 6.0 | 7.4 |
| n: | Cyclohexanediamine tetraacetic acid iron (III) ammonium salt | 7.5 | 5.8 |
| o: | Cyclohexanediamine tetraacetic acid iron (III) ammonium salt | 9.0 | 4.2 |
| p: | Diethylenetriamine pentaacetic acid iron (III) ammonium salt | 3.0 | 9.8 |
| q: | Diethylenetriamine pentaacetic acid iron (III) ammonium salt | 4.5 | 9.5 |
| r: | Diethylenetriamine pentaacetic acid iron (III) ammonium salt | 6.0 | 9.4 |
| s: | Diethylenetriamine pentaacetic acid iron | 7.5 | 9.6 |

TABLE 4-continued

| | Kind of aminocarboxylic acid iron (III) complex | pH | Bleaching speed constant [K]× $10^3$ |
|---|---|---|---|
| t: | (III) ammonium salt Diethylenetriamine pentaacetic acid iron (III) ammonium salt | 9.0 | 9.7 |

As apparently seen from Table 4, the relation between the bleaching speed of the bleach-fixing solution and its pH is influenced by the kind of the aminopolycarboxylic acid iron (III) complex salt, and in any of the bleach-fixing solutions (a) to (o) using Control aminopolycarboxylic acid iron (III) complex salts, the bleaching speed is lowered with increase of pH, thus indicating that pH is correlated with the silver elimination speed. On the other hand, in the case of diethylenetriamine pentaacetic acid iron (III) complex salt which is the bleaching agent employed in the bleach-fixing solution of this invention, the bleaching speed is constant irrespective of pH changes, thus indicating no dependence on pH.

In these Examples, sodium salt and triethanolamine salt were employed as the aminopolycarboxylic acid iron complex salt, and substantially the same results were obtained in both cases.

EXAMPLE 5

Each 6 g of the exemplary cyan coupler (1) of the coupler of the formula [I] or [II] as shown above in exemplary compounds and a known cyan coupler (1') below, 3 g of a high boiling organic solvent dibutylphthalate and 18 g of ethyl acetate, together with a necessary amount of dimethylformamide added, if desired, were mixed. Each mixture was heated to 60° C. to prepare a solution, which was then mixed with 100 ml of an aqueous 5% gelatin solution containing 10 ml of an aqueous 5% solution of Alkanol B (alkylnaphthalene sulfonate, produced by Du Pont de Nemours & Co.), followed by emulsification by means of a ultra-sonic dispersing machine, to obtain a dispersion.

Next, each dispersion was added to a silver iodobromide emulsion (containing 6 mole % of silver iodide) to a cyan coupler content of 10 mole % based on silver, and further 1,2-bis(vinylsulfonyl)ethane was added as the film hardener at a proportion of 12 mg per 1 g of gelatin, and the resultant mixture was applied on a transparent cellulose triacetate film applied with subbing to a coated silver quantity of 35 mg/100 $cm^2$. The sample thus obtained was subjected to wedge exposure in a conventional manner, and then the development processing as shown below was applied thereon.

Cyan coupler (1'):

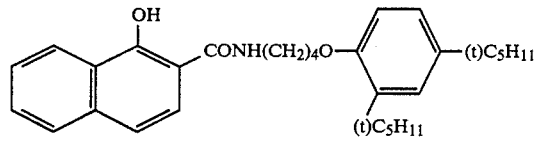

| Processing step | Processing temperature | Processing time |
|---|---|---|
| 1. Color developing | 37.8° C. | 1 min. 30 sec. |
| 2. Bleach-fixing | 37.8° C. | 1 min. to 30 min. |
| 3. Water washing | 30 to 34° C. | 2 min. |
| 4. Stabilizing | 30 to 34° C. | 1 min. |
| 5. Drying | | |

The respective processing solutions were prepared according to the recipes shown below.

| | |
|---|---|
| [Color developer] | |
| Potassium carbonate | 30 g |
| Sodium sulfite | 2.0 g |
| Hydroxylamine sulfate | 2.0 g |
| Potassium bromide | 1.2 g |
| Sodium hydroxide | 3.4 g |
| N—ethyl-N—β-hydroxyethyl-3-methyl-4-aminoalinine hydrochloride | 4.6 g |
| (made up to 1000 ml with addition of water, and adjusted to pH 10.1 with sodium hydroxide) | |
| [Bleach-fixing solution (1)] | |
| Ethylenediaminetetraacetic acid diammonium salt | 7.5 g |
| Ethylenediaminetetraacetic acid iron (III) ammonium salt | 120 g |
| Sodium sulfite | 3 g |
| Ammonium thiosulfate | 90.0 g |
| Water | added to make up 1000 ml |
| [Bleach-fixing solution (2)] | |
| Diethylenetriamine pentaacetic acid | 10 g |
| Diethylenetriamine pentaacetic acid iron (III) ammonium salt | 85 g |
| Sodium sulfite | 3 g |
| Ammonium thiosulfate | 90.0 g |
| Water | added to make up to 1000 ml |
| [Stabilizer] | |
| Formalin (35% aqueous solution) | 7.0 ml |
| 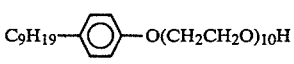 | 1.0 g |
| Water | added to make up 1000 ml |

After color development, processing was conducted with the bleach-fixing solution (1) or (2) adjusted with ammonium hydroxide or acetic acid to the pH as indicated in Table 5, followed subsequently by washing with water and stabilization processing. For each sample, the bleach-fixing completion time (clearing time), the minimum red density, the color restoration of cyan [the maximum red density/the maximum red density according to the standard processing by CNK-4 (color development) for 1 minute and 20 seconds] and the sulfide forming time were observed.

TABLE 5

| Processing No. | Bleach-fixing solution | Coupler | pH | Bleach-fixing completion time* | Time for sulfide formation (days) | Minimum red density | Cyan restoration (%) |
|---|---|---|---|---|---|---|---|
| 1 | (1) | Coupler | 3.0 | 5 min. | 2 | 0.18 | 65 |
| 2 | | (1') | 4.0 | 7 min. | 2 | 0.20 | 69 |
| 3 | | | 5.0 | 16 min. | 5 | 0.22 | 77 |
| 4 | | | 6.0 | >20 min. | 8 | 0.24 | 84 |
| 5 | | | 7.0 | >20 min. | 12 | 0.26 | 93 |

TABLE 5-continued

| Processing No. | Bleach-fixing solution | Coupler | pH | Bleach-fixing completion time* | Time for sulfide formation (days) | Minimum red density | Cyan restoration (%) |
|---|---|---|---|---|---|---|---|
| 6 | | | 8.0 | >20 min. | 20 | 0.32 | 98 |
| 7 | (2) | Coupler (1') | 3.0 | 4 min. 30 sec. | 35 | 0.19 | 69 |
| 8 | | | 4.0 | 5 min. | 45 | 0.20 | 81 |
| 9 | | | 5.0 | 5 min. | >50 | 0.22 | 93 |
| 10 | | | 6.0 | 5 min. | " | 0.24 | 97 |
| 11 | | | 7.0 | 5 min. 10 sec. | " | 0.24 | 96 |
| 12 | | | 8.0 | 5 min. 30 sec. | " | 0.26 | 101 |
| 13 | (1) | Coupler (1) | 3.0 | 5 min. | — | 0.16 | 68 |
| 14 | | | 4.0 | 7 min. | — | 0.20 | 82 |
| 15 | | | 5.0 | 16 min. | — | 0.23 | 86 |
| 16 | | | 6.0 | >20 min. | — | 0.25 | 87 |
| 17 | | | 7.0 | >20 min. | — | 0.26 | 95 |
| 18 | | | 8.0 | >20 min. | — | 0.30 | 99 |
| 19 | (2) | Coupler (1) | 3.0 | 4 min. 30 sec. | — | 0.15 | 82 |
| 20 | | | 4.0 | 5 min. | — | 0.14 | 91 |
| 21 | | | 5.0 | 5 min. | — | 0.14 | 99 |
| 22 | | | 6.0 | 5 min. | >50 | 0.15 | 101 |
| 23 | | | 7.0 | 5 min. 10 sec. | " | 0.14 | 100 |
| 24 | | | 8.0 | 5 min. 30 sec. | " | 0.15 | 100 |

*Silver elimination characteristic

As apparently seen from the results in Table 5, the samples using the bleach-fixing solution of diethylenetriamine tetraacetic acid iron (III) complex salt of Sample Nos. 1 to 6 are improved slightly in hyposulfide forming time and the degree of lowering in the maximum red density (hereinafter called as color restoration of cyan) at pH 5 or higher, but there ensue problems such that bleach-fixing completion time (hereinafter called as silver elimination characteristic) is elongated and also that the minimum red density becomes higher (hereinafter called as cyan stain). This tendency is similar for Sample Nos. 13 to 18 in which the Couplers (1) were substituted for Couplers (1'). Accordingly, when processing was done with a bleach-fixing solution employing diethylenetriamine tetraacetic acid iron (III) complex salt as the bleaching agent, it can hardly be provided for use in practical application merely by change of the coupler.

In contrast, Samples 7 to 12 processed with the bleach-fixing solution (2) according to this invention using the Coupler (1'), while they were found to be markedly improved in silver elimination characteristic as well as restoration of cyan and sulfide forming time, particularly at pH 4.0 or higher, exhibited no marked effect with respect to cyan stain. In this sense, it has been earnestly desired to have a technique for improving cyan stain to a great extent. Whereas, Samples Nos. 19 to 24, in which the Coupler (1) of the couplers of the formula [I] or [II] is combined, cyan stain which was the problem in the case of diethylenetriamine pentaacetic acid copper (III) complex salt was improved to a great extent. Particularly, in Sample Nos. 21 to 24 at pH 4.0 or higher according to the processing method of this invention, silver elimination characteristic, sulfide forming time representative of solution storability, cyan stain and restoration of cyan were found to be markedly improved, thus proving that they are acceptable in practical application.

EXAMPLE 6

A silver halide emulsion was prepared and applied in the same manner as in Example 5 so that the amount of silver coated might be 40 mg/100 cm$^2$. As the cyan coupler, the known couplers (a) to (c) shown below and seven kinds of the exemplary compounds of the couplers of the formula [I] or [II] were employed and applied, respectively.

After giving exposure in a conventional manner as in Example 5, processings were performed. As the bleach-fixing solution, the bleach-fixing solutions (1) and (2) were adjusted to pH 7.0 and provided for use in processing. As a Control, the standard processing according to Sakura nega process CNK-4 (standard processing) (processing by Konishiroku Photo Industry Co., Ltd.). Each bleach-fixing processing was conducted for 25 minutes, while the standard processing was 6 minutes and 30 seconds for bleaching and 6 minutes and 30 seconds for fixing.

Coupler (a)

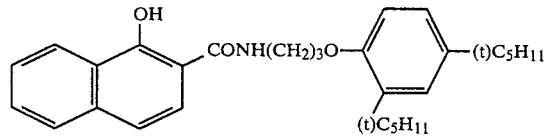

Coupler (b)

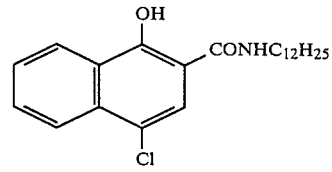

-continued

Coupler (c)

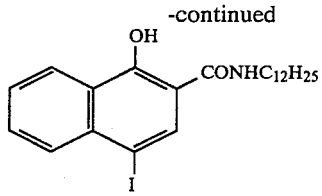

The results of the minimum red density measured similarly as in Example 5 are shown in Table 6.

TABLE 6

| Processing No. | Kind of processing | Coupler | Minimum red density (cyan stain) |
|---|---|---|---|
| 1 | Processing | (a) | 0.27 |
| 2 | with | (b) | 0.28 |
| 3 | bleach- | (c) | 0.24 |
| 4 | fixing | Exemplary compound (2) | 0.29 |
| 5 | solution (1) | Exemplary compound (4) | 0.23 |
| 6 | | Exemplary compound (7) | 0.22 |
| 7 | | Exemplary compound (17) | 0.26 |
| 8 | | Exemplary compound (21) | 0.28 |
| 9 | | Exemplary compound (47) | 0.27 |
| 10 | | Exemplary compound (53) | 0.26 |
| 11 | Processing | (a) | 0.21 |
| 12 | with | (b) | 0.23 |
| 13 | bleach- | (c) | 0.20 |
| 14 | fixing solution | Exemplary compound (2) | 0.15 |
| 15 | (2) | Exemplary compound (4) | 0.15 |
| 16 | | Exemplary compound (7) | 0.13 |
| 17 | | Exemplary compound (17) | 0.13 |
| 18 | | Exemplary compound (21) | 0.15 |
| 19 | | Exemplary compound (47) | 0.12 |
| 20 | | Exemplary compound (21) | 0.14 |
| 21 | Processing | (a) | 0.16 |
| 22 | with | (b) | 0.17 |
| 23 | Sakura | (c) | 0.15 |
| 24 | color nega | Exemplary compound (2) | 0.17 |
| 25 | CNK-4 (Standard | Exemplary compound (4) | 0.16 |
| 26 | processing | Exemplary compound (7) | 0.15 |
| 27 | | Exemplary compound (17) | 0.16 |
| 28 | | Exemplary compound (21) | 0.16 |
| 29 | | Exemplary compound (47) | 0.16 |
| 30 | | Exemplary compound (21) | 0.16 |

As can be seen also from the results in Table 6, when processing was conducted with the bleach-fixing solution of the prior art at pH 7.0, the results of high stain were obtained in both Couplers (a) to (c) and Couplers (2), (4), (7) and so on. On the other hand, in bleach-fixing solutions Processing Nos. 11 to 13 employing diethylenetriamine pentaacetic acid iron (III) complex salt, cyan stain is not lowered so much. In contrast, the Processing Nos. 14 to 20 in which light-sensitive materials containing the Couplers (2), (4), (7) and so on are processed with the bleach-fixing solution using diethylenetriamine pentaacetic acid iron (III) complex salt were found to be markedly lowered in cyan stain, as compared with the processing of the prior art, to obtain values very approximate to the standard values according to the Processing Nos. (21) to (30) processed by the Sakura nega process CNK-4.

We claim:

1. A method for processing a light-sensitive silver halide color photographic material, which comprises developing an imagewise exposed light-sensitive silver halide color photographic material containing a cyan coupler and then bleach fixing with a bleach-fixing solution containing a diethylenetriamine pentaacetic acid iron III complex salt and a fixing agent and having a pH value of 4 or higher; said cyan coupler being at least one cyan coupler represented by the formula (I) or the formula (II) shown below:

Formula (I)

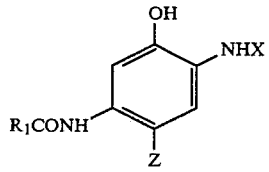

Formula (II)

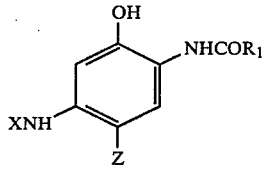

wherein X is $-COR_2$, $-CON\begin{matrix}R_2\\R_3\end{matrix}$, $-SO_2R_2$, $-\underset{\underset{S}{\|}}{C}-N\begin{matrix}R_2\\R_3\end{matrix}$, $-SO_2N\begin{matrix}R_2\\R_3\end{matrix}$, $-SO_2NHCON\begin{matrix}R_2\\R_3\end{matrix}$, $-CONHCOR_2$ or $-CONHSO_2R_2$, $R_2$ represents an alkyl group, an alkenyl group, a cycloalkyl group, an aryl group or a heterocyclic ring; $R_3$ represents a hydrogen atom, an alkyl group, an alkenyl group, a cycloalkyl group, an aryl group or a heterocyclic ring or $R_2$ and $R_3$ may be bonded to each other to form a 5- to 6-membered ring, $R_1$ is a ballast group, Z is a hydrogen atom or an eliminable group through coupling with the oxidation product of an aromatic primary amine color developing agent.

2. The method according to claim 1, wherein the pH value ranges from 5 to 9.

3. The method according to claim 2, wherein the pH value ranges from 6 to 8.5.

4. The method according to claim 1 wherein said diethylenetriamine pentaacetic acid iron (III) complex salt is used at 0.01 mol or more per one liter of the bleach-fixing solution.

5. The method according to claim 1, wherein said bleach-fixing solution has a silver ion concentration ranging from 5 to 50 g/liter when calculated in terms of metallic silver.

6. The method according to claim 1, wherein the group represented by $R_2$ is an alkyl group having 1 to 20 carbon atoms, an alkenyl group having 2 to 20 carbon atoms, a cycloalkyl group of a 5- to 7-membered ring, a phenyl group, a tolyl group, a naphthyl group, or a heterocyclic group of a 5- to 6-membered ring containing 1 to 4 nitrogen atom, oxygen atom or sulfur atom; and the group represented by $R_3$ is a hydrogen atom or the group represented by $R_2$.

7. The method according to claim 1, wherein the ballast group represented by $R_1$ is a ballast group necessary for imparting diffusion resistance to the cyan coupler represented by the formulae [I] and [II] and the cyan dye formed from said cyan coupler.

8. The method according to claim 1, wherein the eliminable group represented by Z is a halogen atom; or an aryloxy group, a carbamoyloxy group, a carbamoylmethoxy group, an acyloxy group, a sulfonamide group or a succinimide group, of which oxygen atom or nitrogen atom is bonded directly to the coupling position.

9. The method according to claim 1, wherein the cyan coupler is selected from the group consisting of the cyan couplers represented by the formula [III], the formula [IV] and the formula [V] shown below:

Formula [III]

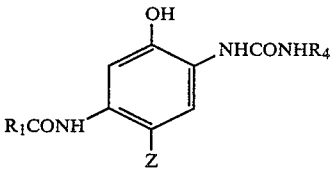

Formula [IV]

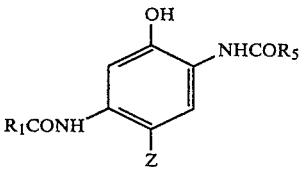

Formula [V]

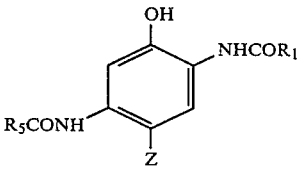

wherein $R_4$ in the formula [III] is an unsubstituted aryl group or an aryl group substituted with at least one of substituents selected from the group consisting of $-SO_2R_2$, halogen atoms, $-CF_3$, $-NO_2$, $-CN$, $-COR_6$, $-COOR_6$, $-SO_2OR_6$,

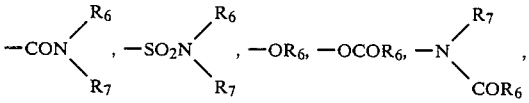

-continued

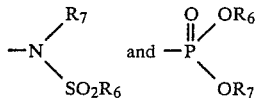

(wherein $R_6$ represents an alkyl group having 1 to 20 carbon atoms, an alkenyl group having 2 to 20 carbon atoms, a cycloalkyl group of a 5- to 7-membered ring, or an aryl group selected from phenyl group, tolyl group, naphthyl group), and $R_7$ represents a hydrogen atom or a group represented by the $R_6$); $R_5$ in the formulae [IV] and [V] is an alkyl group having 1 to 20 carbon atoms, an alkenyl group having 2 to 20 carbon atoms, a cycloalkyl group of a 5- to 7-membered ring, an aryl group selected from phenyl group, tolyl group, naphthyl group, or a heterocyclic group of a 5- to 6-membered heterocyclic ring containing 1 to 4 nitrogen atom, oxygen atom or sulfur atom; and Z and $R_1$ in the formulae [III], [IV] and [V] are the same as defined above.

10. The method according to claim 9, wherein the group represented by $R_4$ in the Formula [III] is a substituted or unsubstituted phenyl group.

11. The method according to claim 9, wherein the groups represented by $R_6$ and $R_7$ in the formula [III] and the group represented by $R_5$ in the formulae [IV] and [V] include as a substituent a halogen atom introduced therin.

12. The method according to claim 9, wherein the ballast group represented by $R_1$ is a group represented by the formula [VI] shown below:

Formula [VI]

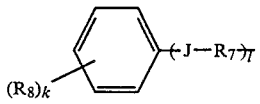

wherein J represents an oxygen atom or a sulfur atom or a sulfonyl group; k is an integer of 0 to 4; l is 0 or 1; when k is 2 or more, $R_8$ exsiting in number of two or more may be either the same or different; $R_7$ is an alkylene group having 1 to 20 carbon atoms which may be straight, branched or substituted with aryl group; $R_8$ represents a monovalent group selected from the group consisting of hydrogen atom, halogen atoms, straight or branched alkyl groups having 1 to 20 carbon atoms, heterocyclic groups, straight or branched alkoxy groups having 1 to 20 carbon atoms, aryloxy groups, hydroxy, acyloxy groups, carboxy, straight or branched alkyloxycarbonyl groups having 1 to 20 carbon atoms, aryloxycarbonyl groups, alkylthio groups having 1 to 20 carbon atoms, acyl groups, acylamino groups, sulfonamide groups, carbamoyl groups and sulfamoyl groups.

* * * * *